US005660133A

United States Patent [19]

Munich

[11] Patent Number: 5,660,133

[45] Date of Patent: Aug. 26, 1997

[54] FENDER MOUNTING SYSTEM AND METHOD FOR BOATS

[76] Inventor: William Munich, P.O. Box 328, East Sound, Wash. 98245

[21] Appl. No.: 638,303

[22] Filed: Apr. 26, 1996

[51] Int. Cl.[6] ..... B63B 39/02

[52] U.S. Cl. ..... 114/219; 114/218; 24/130; 248/65

[58] Field of Search ..... 114/218, 219, 114/220; 24/130; 248/58, 59, 62, 63, 65, 69, 74.2

[56] References Cited

U.S. PATENT DOCUMENTS

| | | | |
|---|---|---|---|
| 407,573 | 7/1889 | Campbell . | |
| 2,267,469 | 12/1941 | Joys . | |
| 2,386,129 | 10/1945 | Maack . | |
| 2,616,646 | 11/1952 | Matthysse | 248/65 |
| 2,942,314 | 6/1960 | Debner et al. . | |
| 3,017,205 | 1/1962 | Williams . | |
| 3,055,333 | 9/1962 | Ryan . | |
| 3,436,108 | 4/1969 | Van Buren, Jr. . | |
| 3,650,236 | 3/1972 | McFarlane . | |
| 4,222,157 | 9/1980 | Forman . | |
| 4,404,712 | 9/1983 | Northe et al. . | |
| 4,673,151 | 6/1987 | Pelz . | |
| 4,930,193 | 6/1990 | Baker . | |
| 4,998,495 | 3/1991 | Bos et al. | 114/218 |

*Primary Examiner*—Jesus D. Sotelo

*Attorney, Agent, or Firm*—Robert B. Hughes; Hughes, Multer & Schacht

[57] ABSTRACT

A mounting block by which a fender can be mounted to a stanchion of a railing of a boat. The mounting block has a horizontal access slot, and two laterally extending upper and lower slots which extend in opposite directions. One end of a rope is attached to the fender and another end of the rope extends through two passageways in the mounting block. The mounting block is mounted to the stanchion by moving an access slot of the block into engagement with, after which the block is rotated 90° so that the stanchion extends vertically through the base sections of the upper and lower slots.

20 Claims, 7 Drawing Sheets

FENDER MOUNTING SYSTEM AND METHOD FOR BOATS

BACKGROUND OF THE INVENTION

1. Field of the Invention

The present invention relates to a system and method for mounting an object, such as a fender for boats, to a structure, such as a boat. More particularly, this relates to such a system and method where there is provided a mounting block which is adjustably connected to a rope that in turn connects to a fender, with the mounting block being arranged to be conveniently and adjustably attached and detached to an elongate member on the boat, and desirably be attached to a stanchion for the rail on the boat.

2. Background Art

When a boat is being docked, it is common to position several fenders along the side of the boat so that the fenders are positioned between the side of the hull of the boat and the dock to cushion any impact. Quite commonly these fenders are elongate cylindrical members that are connected at one end to a rope that in turn is tied or attached by tieing the rope around the railing of the boat.

There are various mechanical devices to attach the upper end of the rope to the boat, and to the best knowledge of the applicant, most of these are designed to connect to the horizontal rail. Also, the rope may be attached or tied to a cleat or other object.

It is elementary that any device or system that is used on a boat should be reliable, easily stowable (if it is to be stowed) and also convenient to mount or dismount (or connect or disconnect) if that is part of the function of the device. Further, it should as much as possible be what is termed in the vernacular as "idiot proof" in that it has a low probability of being operated or manipulated ineptly so that it will not function as intended.

Another consideration is that any device such as this should lend itself to economy of production. If the device or any component is to be made of plastic, it is also desirable that this could conveniently be made by an economical method, such as injection molding.

A search of the patent literature has disclosed a number of devices used in connecting or fastening various objects. These are the following;

There are three patent which show a method of connecting a line to a boat.

U.S. Pat. No. 3,650,236 (McFarlane) shows what is called a "marine line holder" where there is an attaching device with an open vertical slot which tapers inwardly in a downward direction. A rope with a knot tied at the end is inserted into the upper end of the slot, and as the rope drops downwardly the knot is retained within the sloped sidewall.

U.S. Pat. No. 3,055,333 (Ryan) shows an anchor retaining device which is bolted or otherwise secured to a structure to hold a cable. This retaining device has two adjacent rigid loop portions, each having slotted openings through which the cable can pass and engage the loop portions in various ways to be attached.

U.S. Pat. No. 2,267,469 (Joys) shows a sail slide fixture, where there is a clip 19 attached to a rope connected to the sail. The clip in turn connects to a member having two laterally spaced oppositely extending fingers to connect to a guy wire 11.

Two of the patents developed in the search disclose a method of connecting one part of a rope or cable to another part of the rope or cable.

U.S. Pat. No. 4,404,712 (Northe et al) shows a sling hook where there is a hook portion 28 and another portion having a curved opening which can receive a cable to which the sling hook is attached.

U.S. Pat. No. 4,930,193 (Baker) shows a cable retainer to be used in logging. There is one cable 33 that has an enlarged ferrule 41 attached thereto. The cable 33 fits in one opening of the retainer and is retained therein by the ferrule 41 fitting in an enlarged recess in the device. The other cable 30 is removably connected to the device through a slanted side opening into a passageway having an enlarged recess positioned oppositely to the other recess, and a ferrule of the second cable fits in that recess.

Two patent show devices for tightening a rope by doubling the rope back over on itself by means of an adjustable member.

One of these is U.S. Pat. No. 4,222,157 (Forman). This patent shows a rope tightening device which is a plate-like member having two laterally spaced openings. One end of the rope is attached by a knot to one of the openings and two laterally spaced openings. One end of the rope is attached by a knot to one of the openings and looped back through the other opening so as to form an adjustable loop portion.

The second patent is U.S. Pat. No. 407,573 Campbell) which shows a rope clasp having a loop portion which is in turn connected to two oppositely extending fingers defining a slot into which the rope is inserted.

Two of the patents disclosed in the search show a means of connecting two cords, ropes or wires to one another.

U.S. Pat. No. 2,942,314T (Debner et al) shows a device for clamping two cord lengths parallel to one another. There are two laterally spaced "S" shaped sections connected together by their middle portions. The upper two arms of the two "S's" are disposed oppositely to one another to engage a cord in the recesses of the upper "S" portions, and the lower "s" portions receive the other cord.

U.S. Pat. No. 3,017,205 (Williams) shows a fastener to attach two wires to one another so that these extend at right angles to one another. The device has a central slot to receive one wire, and on opposite sides of that slot there are two oppositely extending semi-circular bight portions 11 which grip the other the other wire. The particular function of this is to secure together the wires which support tobacco plants or netting.

Two of the patents show devices for connecting a wire or cable to a stationary member.

U.S. Pat. No. 2,386,129 (Maack) shows a wire holder by which, for example, a wire can be attached to a metal fence post. This is a flat metal piece having two laterally spaced oppositely extending retaining tongues 20, and this is mounted to the post by the tongue 20 gripping the post. Then the wire holder has a lug 15 which has two oppositely extending members. The wire is inserted into an opening between these members and then turned to fit therein (see FIG. 15).

U.S. Pat. No. 4,673,151 (Pelz) shows a clip having a flat body 12 which is mounted to a structure (e.g. in a truck) and two semi-circularly curved fingers spaced laterally from one another and facing oppositely. A line, such as an hydraulic line in a truck or electrical cables is inserted into the clip by passing it through a slanted access opening in-between the two fingers.

Finally, U.S. Pat. No. 3,436,108 (Buren Jr.) discloses a clip for connecting thin plastic panels or liners to the inside of a supermarket shopping cart.

SUMMARY OF THE INVENTION

The present invention is intended to provide a convenient and reliable way of mounting an object to an elongate structure, and is particularly adapted for marine use, to accomplish the task of mounting a fender to a boat, and more particularly to mounting a block to a stanchion or other elongate member on the boat, and connecting the feeder to the block by rope means.

The mounting assembly of the present invention first comprises an elongate substantially rigid support member (e.g. a stanchion) having a maximum width dimension, with the elongate support member being supported from the basic support structure, such as a boat.

There is a mounting block adapted to be removably mounted to the support member. This block has a top, bottom, forward side, back side and two lateral sides. The block has a primary axis extending through the block from top to bottom, a forward to rear axis which extends through the block, with the primary axis having a major alignment component perpendicular to the forward to rear axis, and a lateral axis which extends through the block laterally and intersects both the primary axis and the front to rear axis. The lateral axis has a major alignment component generally perpendicular to the both primary axis and the front to rear axis.

The block is formed with an access slot which lies in a plane having a substantial alignment component aligned with the lateral axis and the forward to rear axis. The access slot opens from a front part of the block to the lateral axis. The access slot has a back surface portion configured to enable the support member to be positioned within the block to be generally aligned with the lateral axis.

The block has an upper positioning slot which extends from the primary axis laterally with the upper slot being configured to receive the support member. The upper slot has an inner surface portion at a base of the upper slot to engage the support member when it is positioned generally aligned with the primary axis.

The block also has a lower positioning slot which extends from the primary axis laterally in a direction substantially opposite to the upper slot. The lower slot is configured to receive the support member and has an inner surface at a base of the lower slot to engage the elongate member when it is positioned generally aligned with the primary axis.

The access slot has slot defining surfaces which are spaced and configured to permit the block to be moved into engagement with the support member with the support member being received in said access slot and positioned at a base portion of the access slot so that the lengthwise axis of the support member is generally aligned with the lateral axis of the block, and also with the support member being aligned with the upper slot and the lower slot.

The upper slot opens to the base portion of the access slot, and the lower slot also opens to the base portion of the access slot. Each of the upper and lower slots has an open area sized to accommodate therein the support member. Thus, with the support member being positioned at the base of the access slot, the block can be rotated generally in a plane occupied by the lateral axis and the primary axis to move to a position where the support member is positioned in the base portion of the upper and lower slots.

These defining surfaces of the upper and lower slots and the support member are sized relative to one another so that the support member is engaged by said slot defining surfaces to hold the block in its supporting position on the support member.

There is a rope means having one end connected to said object which is to be supported, and a second end portion connecting to the block.

Thus, the block can be mounted to the support member by aligning the access slot with the support member and moving the block relative to the support member so that the support member moves into the access slot to be positioned in the base of the access slot. Then the block is rotated so that the support member passes into the upper and lower slots to position the block so that the primary axis of the block is generally aligned with the primary axis of the support member.

In the preferred form, the block has an upper portion defining the upper slot, a lower portion defining the lower slot, and an intermediate portion positioned rearwardly of the access slot and interconnecting the upper portion and the lower portion. The intermediate portion forms with back parts of the upper and lower portions a back section of the block. The back section of the block has through passageway means adapted to receive the rope means to connect the rope means to connect the rope to the block.

In the preferred form, the passageway means comprises two passageways to receive the rope means in a manner that the rope means can be passed through said two passageways and be pulled into securing relationship of the two passageways. In one arrangement, the passageways are aligned to have a substantial vertical alignment component. In another arrangement, the passageways are aligned to have a substantial horizontal alignment.

In one version, the upper slot has side walls defining the upper slot and the lower slot has sidewalls defining the lower slot. The side walls of the upper slot are moderately out of alignment with side walls of the lower slot, thus causing the side walls of the upper and lower slots to at least assist in providing gripping engagement to the support member. In one version, the lengthwise axes of the upper and lower slots form an angle less than 180°. In another arrangement, the side walls of the upper and lower slots are moderately out of parallel alignment with respect to each other, relative to the primary axis.

In the preferred form, the block is a unitary structure made of a plastic material which is able to yield moderately to have a friction fit with said support member.

The present invention also comprises the mounting block itself, as described above, to be used in securing the object to the support member.

Also, the present invention includes the method of mounting the mounting block to the support member to support an object, such as supporting a fender from a boat.

Other features of the present invention will become apparent from the following detailed description.

DESCRIPTION OF THE PREFERRED EMBODIMENT

Figure 1:
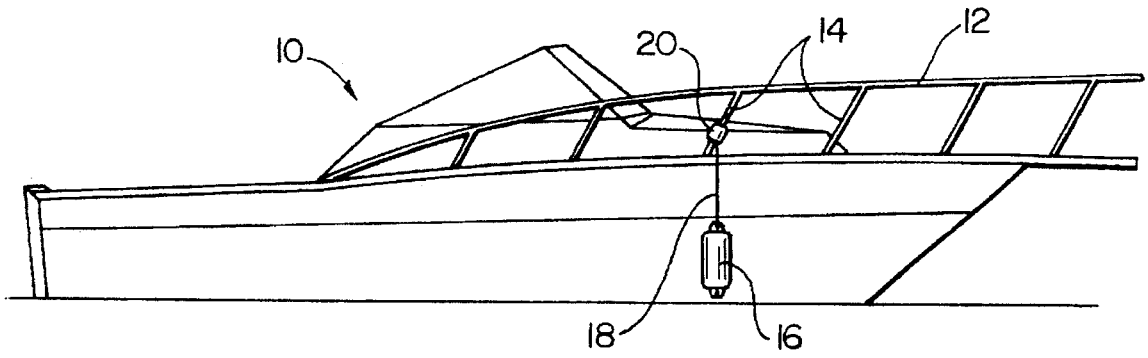
FIG. 1 is a view showing a boat where the present invention is being used to connect a fender to a stanchion of the boat, with the fender hanging over the side of the boat in its operating position.

In FIG. 1, there is shown a boat 10 having a rail 12 extending horizontally along the deck, with the rail 12 being supported by a number of stanchions 14. There is shown a fender 16 connecting to a rope 18 which is in turn adjustably connected to a mounting block 20 that is mounted to the stanchion 14.

The manner in which the fender 16 is used will depend upon the preference of the boat operator and other factors. In some instances, several fenders 16 remain connected by its related rope 18 to the boat in some manner at the operating position for extended periods of time. Thus, when the boat is not docking, the fenders 16 are simply pulled up and placed at some location on the deck. In other instances, when the boat is not docking, the boat operator may want to detach the fenders from the operating position and stow these where they can again be taken out and attached in the operating position when the boat is docking. The present invention is particularly adapted for use in either situation. First, the mounting block 20 can simply remain in place connected to both the rope 18 and the stanchion 14 for extended periods of time. Also, the mounting block can be easily removed from the stanchion 14 and be stowed with the rope 18 and the fender 16 in an appropriate place. When the fender 16 is needed, the mounting block 20 can easily be reattached to the stanchion 14. Another advantage is that the mounting block 20 itself can easily adjusted vertically (or angularly about its vertical axis) on the stanchion 14 to change the elevation and/or orientation of the fender 16. Also, the rope 18 can have its position easily adjusted within the mounting block 20.

Figure 2:
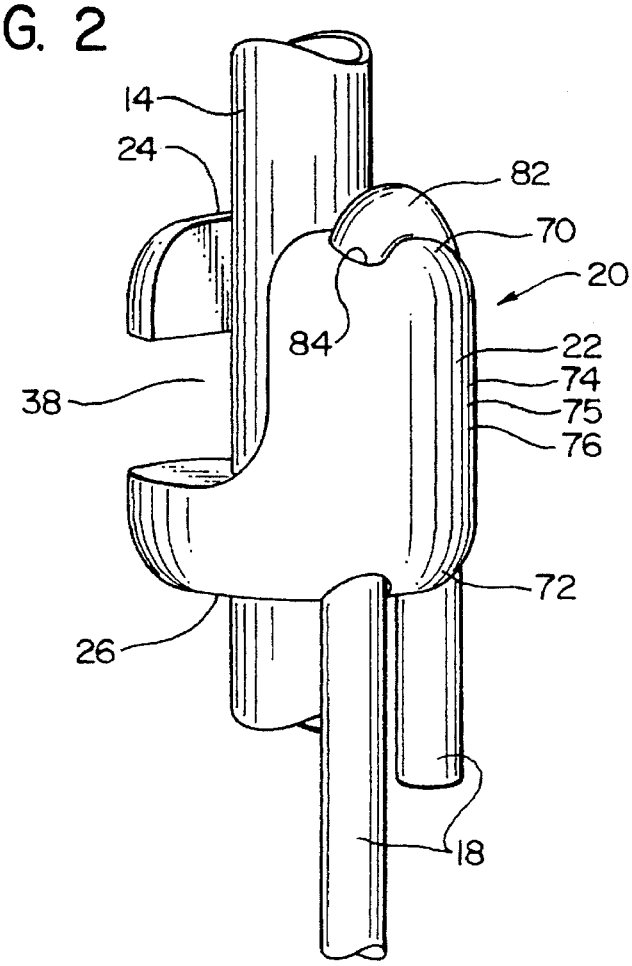
FIG. 2 is an isometric view illustrating the mounting block of the present invention in its operating position mounted to a stanchion and connecting to a fender line.

Reference is now made to FIG. 2 which shows the manner in which the mounting block 20 interconnects with the stanchion 14 and also with the rope 18. The rope 18 is looped through the block 20 in a "U" shaped configuration so that the rope can be pulled tight in the block 20 so as to be fixedly secured thereto, and can also be loosened in the block 20 and moved along its length relative to its block 20 so as to position the fender 16 at the desired elevation. Also, the mounting block 20 snugly engages the stanchion 14 in a manner that it is reliably connected to the stanchion. Yet, the block can be adjusted vertically or rotated about the stanchion 14. As will be discussed more particularly later in this text, the block 20 can easily be mounted to or removed from the stanchion 14 in a particularly effective and reliable manner.

It is believed that a clearer understanding of the present invention will be obtained by reviewing at this time briefly the manner in which the mounting block 20 is mounted to the stanchion 14, with reference to FIGS. 9 through 12. After that, the mounting block 20 will be described in greater detail, and then the interaction of how the block 20 connects to the stanchion 14 will be discussed in more detail with further reference to FIG. 9 through 12.

Figure 9:
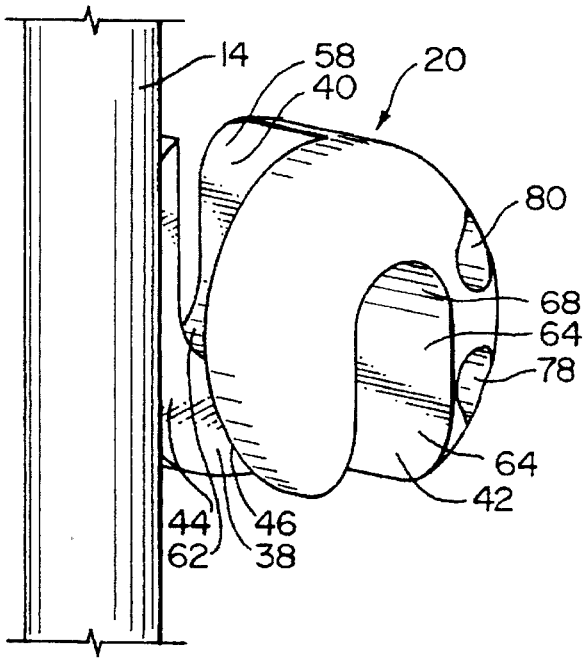
FIGS. 9 through 12 are four isometric views showing in sequence the manner in which the mounting block is connected to the stanchion.
Figure 10:
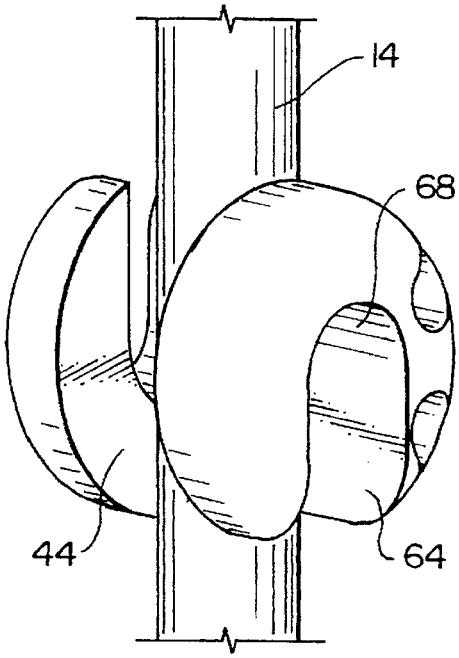
Figure 11:
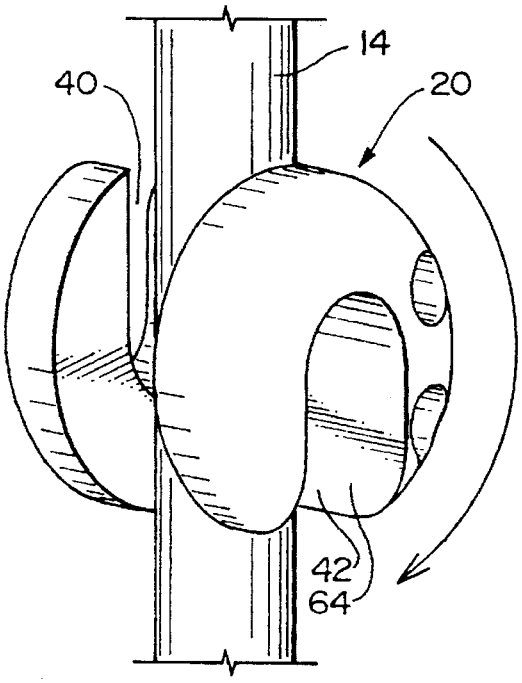

For the present, it will be sufficient to note that the block 20 is initially positioned as shown in FIG. 9, and then moved into engagement with the stanchion 14, as shown in FIG. 10. Then as shown in FIG. 11, the block 20 is rotated 90° to arrive at the position shown in FIG. 12. For ease of illustration, the rope is not shown in the sequence of FIGS. 9 through 12, it being understood that during the mounting operation of FIGS. 9 through 12, the rope would be extending from the block 20, as shown in FIG. 2.

The mounting block 20 is desirably made of a plastic material and is of integral substantially rigid construction. However, the material will yield elastically to some extent so that it can have a close friction fit with the stanchion 14 so as to properly grip the stanchion 14. Also, the block 20 is configured so that it can readily be made by injection molding.

The block 20 has a generally cylindrical configuration and thus comprises a cylindrical sidewall 22, a top surface 24 and a bottom surface 26. The terms "top" and "bottom" are used mainly for convenience of description. Actually, the block 20 is made symmetrically about a horizontal plane midway through the block 10, so the top and bottom ends can be inverted and functions in exactly the same way. This is one of the several features which allows the present invention to be used more reliably.

Figure 3:
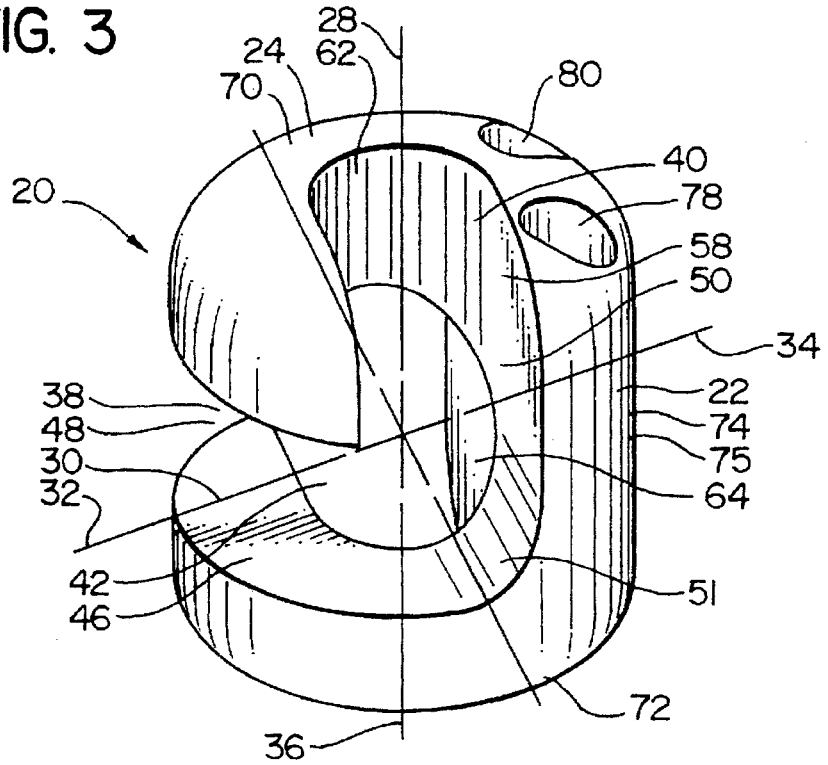
FIG. 3 is an isometric view of the mounting block of the present invention, showing its axes of orientation.
Figure 4:
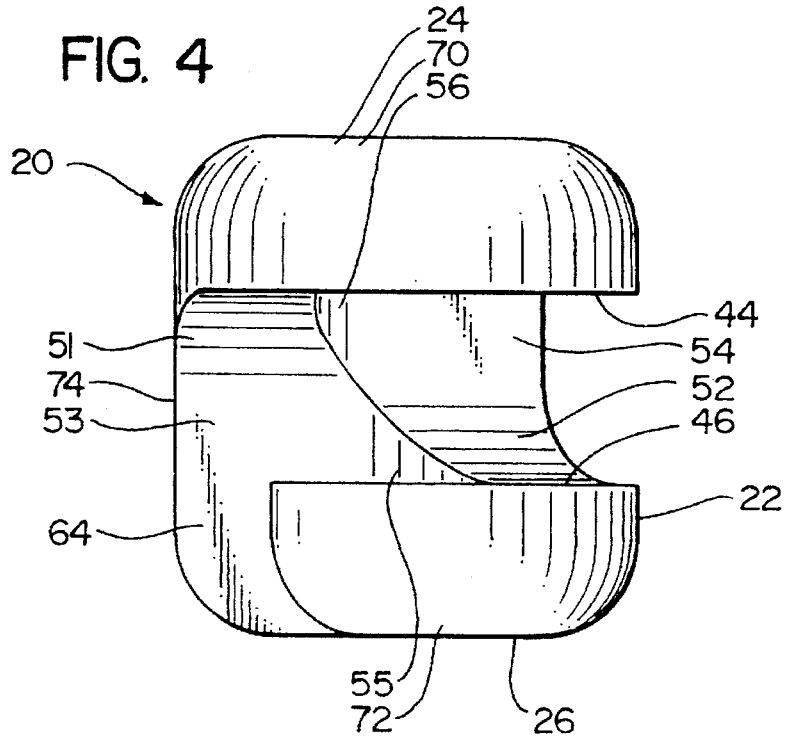
FIG. 4 is an elevational view of the mounting block taken from a left front location
Figure 5:
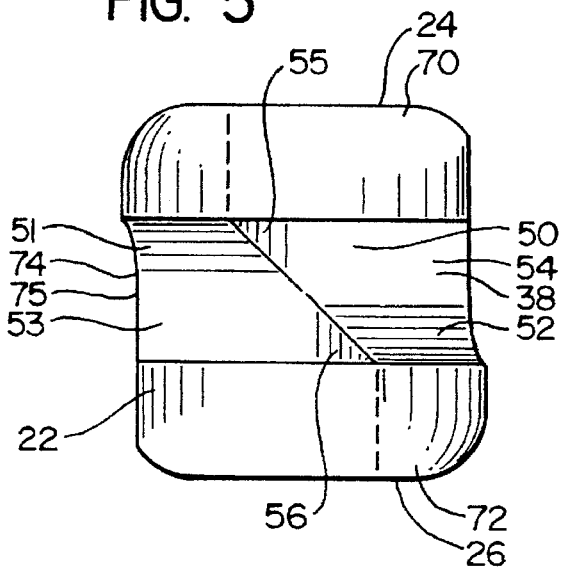
FIG. 5 is a front elevational view of the mounting block.
Figure 6:
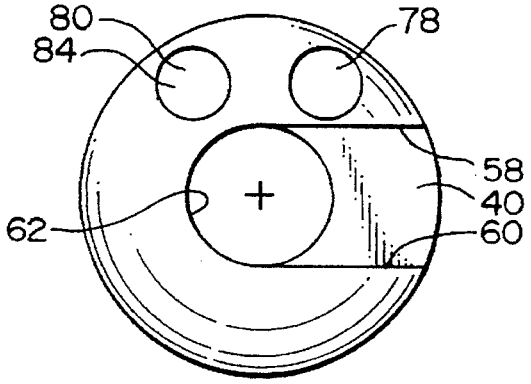
FIG. 6 is a top plan view thereof.
Figure 7:
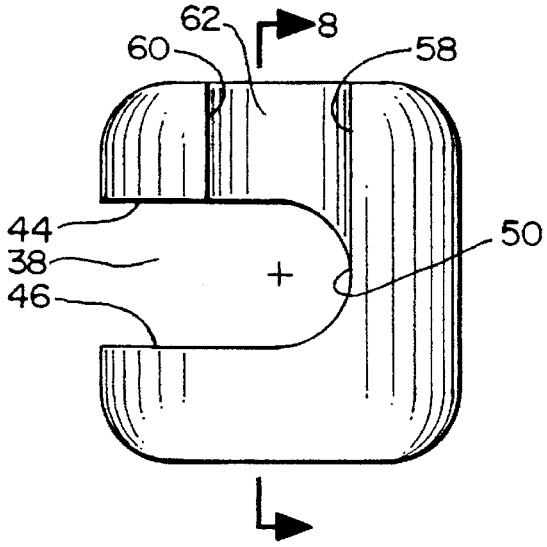
FIG. 7 is a side elevational view of the mounting block, taken from a view at the right hand side of FIG. 4.
Figure 8:
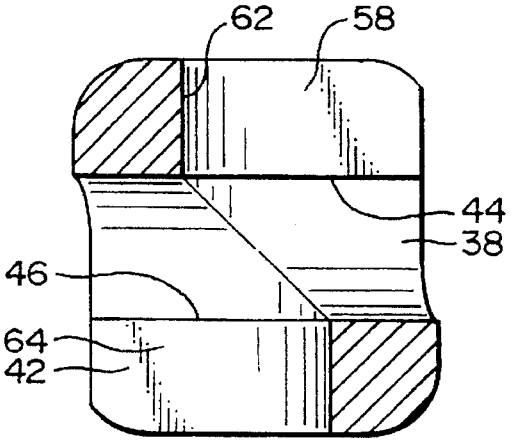
FIG. 8 is a sectional view taken along line 7—7 of FIG. 6.

For purposes of description, with reference to FIG. 3, the block 20 shall be considered as having a longitudinal center axis 28 which coincides with the longitudinal center line of the cylindrical sidewall 22. The block 20 also has a forward to rear axis 30, which in FIG. 3 has a forward end 32 and a rear end 34. Then there is a lateral axis 36 perpendicular to both the center axis 28 and forward to rear axis 30.

The block 20 is formed with three slots. First, there is a forwardly open horizontally aligned access slot 38 which extends through the front of the block 20 and extends moderately beyond the lateral axis 36. Second, there is an upper lateral or side slot 40 which opens to the right side of the block and also extends into the block 20 moderately beyond the longitudinal center axis 28. Third, there is a lower side slot 42 which opens to the left side of the block and extends inwardly moderately beyond the longitudinal center axis 28.

The access slot 38 is defined by an upper flat surface 44 and a lower flat surface 46. The spacing of these two surfaces of 44 and 46 is in the preferred embodiment the same as (or slightly smaller than) the diameter of the stanchion 14. Thus, when the stanchion 14 is inserted into the front opening 48 of the access slot 38, it has a frictional fit with the walls 44 and 46.

There is a laterally extending interior surface 50 defining the rear of the slot 38. There is an upper left and a lower right cylindrically curved section, 51 and 52, respectively, each having a 90° curve with the radius of curvature the same as that of the outside cylindrical surface of the stanchion 14.

Then there is a lower left and an upper right flat section 53 and 54, respectively. Between the flat section 53 and the cylindrical section 52, there is a cylindrical curved section 55, with the axis of the curvature being vertically oriented. At the location between the flat section 54 and curved section 51, there is another cylindrically curved surface 56 with the axis of curvature being vertically oriented. The radius of curvature of the two surfaces 55 and 56 is the same as the radius of curvature of the stanchion 14. In the final mounted position of the mounting block 50, the stanchion 14 engages these two surfaces 55 and 56.

The upper slot 40 comprises a rear forwardly facing vertical side wall 58 and a front rearwardly facing vertical sidewall 60. The inner surface 62 of the upper slot 40 has a vertically aligned cylindrically curvature the same as that of the stanchion 14. The upper slot sidewalls 58 and 60 are spaced by a distance substantially the same as, or possibly slightly less than, the diameter of the stanchion 14. Thus, the sidewalls 58 and 60 have a close friction fit with the stanchion 14. Also, the upper slot 40 is aligned with the lateral axis 36 and opens to the right.

The lower slot 42 is defined by vertically aligned rear forwardly facing sidewall 64 and a forward rearwardly facing sidewall 66. The lower slot 44 is further defined by a cylindrically curved inner surface 68 having a radius of curvature substantially the same as that of the stanchion. The spacing of the side walls 64 and 66 is substantially the same as, or slightly smaller than, the diameter of the stanchion 14 so that these are in snug engagement with the stanchion 14. The lower slot 44 opens to the left in a direction opposite to the upper slot 46.

The block 20 can be considered as having a top portion 70, a bottom portion 72, and an intermediate portion 74. The top portion 70 in terms of function primarily provides and defines the upper slot 40 which with its containing walls or surfaces 58, 60 and 62 positions the block 20 relative to the stanchion 14 at one location. In like manner, the lower portion 72 has a primary function of defining the lower slot 42 with its defining walls or surfaces 64, 66 and 68 that engages and positions the stanchion 14 at a location spaced from the first engaging area. Also, the top and bottom portion 70 and 72 define the access slot 38.

The intermediate section 74 provides a connecting back section 75 which engages the back parts of both the top portion 70 and the lower portion 72 so that collectively these could be considered as a back section 76 of the block 20, extending the entire vertical length of the block 20. This back section 76 has two laterally spaced, longitudinally aligned cylindrical through passageways 78 and 80 which open at both the top and bottom of the block 20. As indicated in FIG. 2, the rope 18 is attached to the block 20 quite easily by simply inserting the end of the rope 18 upwardly through the one passageway 78, and then turning it 180° to run it through the other passageway 80. When the rope 18 is pulled tight so that the loop portion 82 is positioned closely to its adjacent openings 84 at the top of the block 20, the rope 18 is securely held in the block 20. However, the position of the rope 18 relative to the block 20 can be adjusted simply by raising the looped portion 82 and then running the rope lengths through the appropriate locations and tightening up the loop at 82.

To describe the method of mounting the block 20 to the stanchion 18, reference is now again made to FIGS. 9 through 12. As indicated earlier, usually the rope 18 would already have been inserted through the passageways 78 and 80. However, the rope 18 is not shown in FIG. 9–12 for convenience of illustration. Initially, the block 20 is positioned so that the access opening 38 is vertically aligned, as shown in FIG. 9. Then the block 20 is moved into engagement with the stanchion 14, so that the two surfaces 44 and 46 defining the slot 38 engage the stanchion 14 with reasonable snugness as it passes between the surfaces 44 and 46.

With the stanchion 14 engaging the back surface 50 of the slot 38, the block 20 is in a position to be rotated, as shown in FIG. 11. It will be noted that in the position of FIG. 11, the slots 40 and 42 are in alignment with the stanchion 14. The block 20 is rotated 90° to the position of FIG. 12, and the stanchion 14 is now positioned within the back portion of each of these slots 40 and 42.

As indicated previously the slot defining surfaces 58 and 60 and also 64 and 66 are sized and configured so as to make a snug friction fit with the stanchion 14. Thus, the block 20 is held at a vertical position on the stanchion 14. Depending upon the force of the friction fit, the block 20 can be raised or lowered on the stanchion 14 with a predetermined force applied thereto. Alternatively, to reposition the block 20, it could be removed from the stanchion 14 and again mounted to the stanchion 14 at another location.

It should also be recognized that the walls of the two lateral slots 40 and 42 be configured or aligned in various ways to more securely mount the block 20 to the stanchion 14. For example, as shown the two slots 40 and 42 are aligned with one another so as to be at a 180° angular spacing, with all of the slot defining side walls parallel with one another. However, this angular alignment could be modified from 180° to a slightly lesser angle so that there would be a moderately slanting engagement in the two slots 40 and 42. The two root portions of the two slots 40 and 42 would remain vertically aligned so that there may be a less restraining friction fit when the block is positioned with the stanchion against both rear slot walls 62 and 68.

As indicated above, while in FIG. 9–12 the method of mounting is shown without the rope 18 connected to the block 20, generally the rope 18 would remain attached in the block 20. The block 20 can be disengaged from the stanchion 14 simply be reversing the steps noted above. Thus, the block 20 is rotated 90° to place the access slot 38 in alignment with the stanchion 14, after which the block 20 is pulled away from the stanchion 14.

Figure 13:
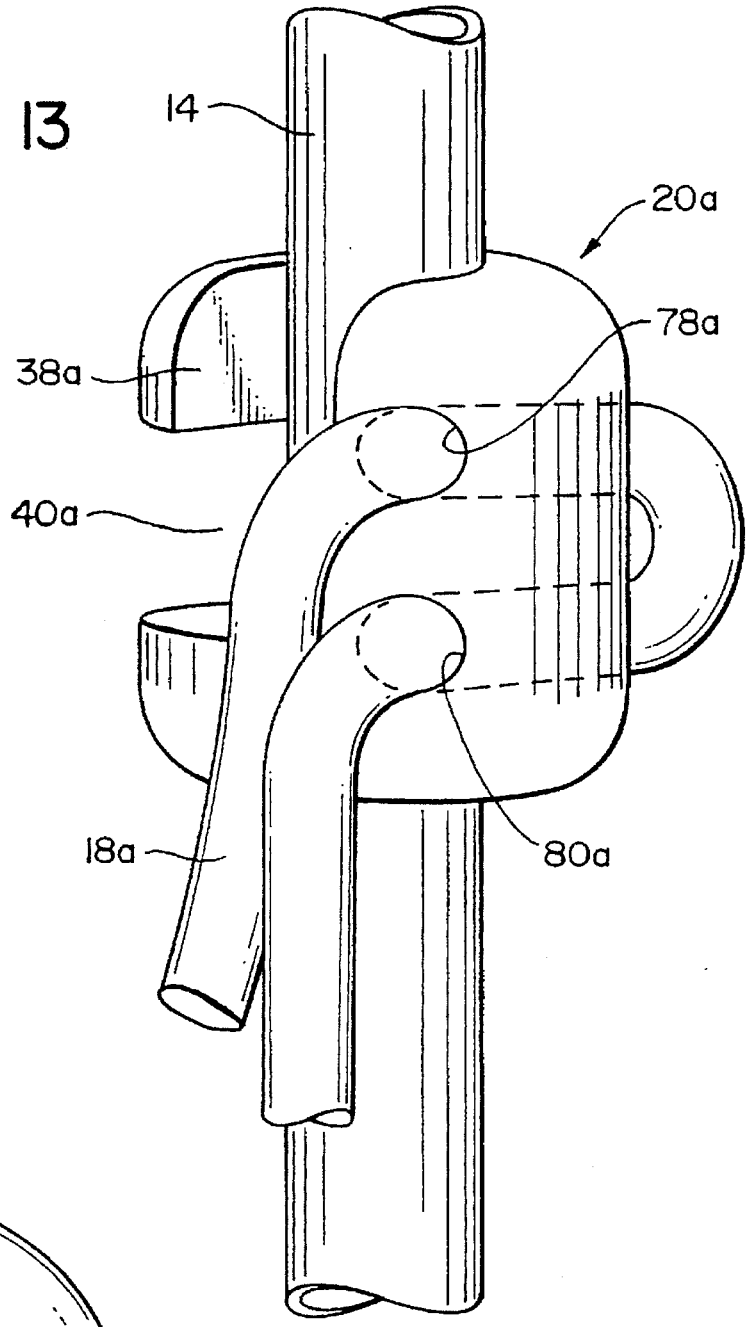
FIG. 13 is an isometric view showing a second embodiment of the present invention.
Figure 14:
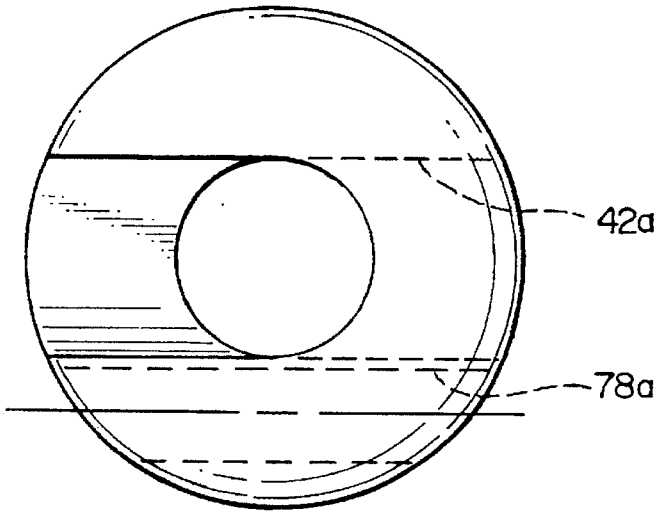
FIG. 14 is a top plan view of the block shown in FIG. 13.

A second embodiment of the present invention is shown in FIGS. 13 and 14. Components of the second embodiment which are similar to components of the first embodiment will be given like numerical designations, with an "a" suffix distinguishing those of the second embodiment. The basic configuration of the block **20*a* and the three slots 38*a*, 40*a*, and 42*a* are substantially the same as those in the prior embodiment. However, instead of forming the two passageways 78*a* and 80*a* vertically, these are formed in the back section 76 so as to extend parallel to the lateral axis 36 and be spaced vertically from one another. The rope 18*a* is inserted through the openings 78*a* and 80*a* so that the end of the rope attached to the fender 16 extends from the end of the lower passageway 80*a* at a location furthest from the back surface 68 of the lower slot 542. Thus, if there is a lateral force applied to the rope 16*a*, there is more of a tendency to turn the block 20 about the stanchion 14 so that the back surface 68 of the lower slot 42 is pulled against the stanchion 14. This lessens any tendency for the block 20** to slip off the stanchion.

It was indicated earlier herein that the engagement of the block 20 with the stanchion 18 could be enhanced by possibly misaligning the lateral slots 40 and 42 to some extent. This is illustrated as third and fourth embodiments, shown in FIGS. 14 and 15, respectively.

Figure 12:
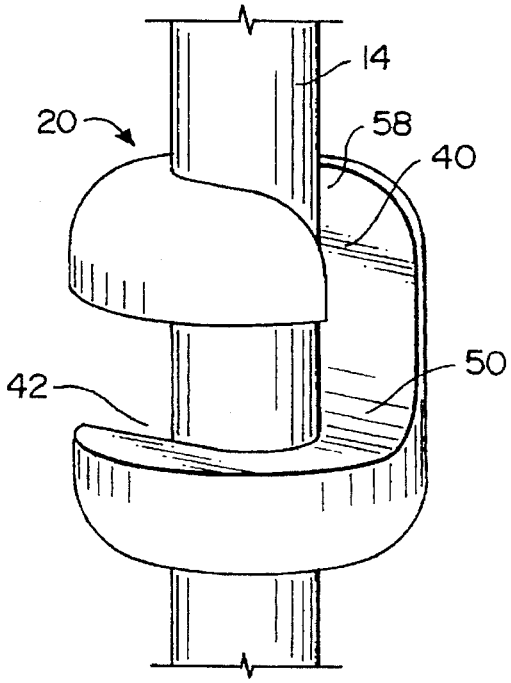

The third embodiment of the present invention is illustrated somewhat schematically in FIG. 14. The center axis of the upper slot 40 is indicated at "g", and the center axis of the lower slot 42 is indicated at "h". The angle formed by these two slots (indicated at "j") is slightly less than 180°. Thus, as the block 20 is moved into mounting engagement with the stanchion 14, as the stanchion moves from the position aligned with the access slot 38, and into the slots 40 and 42, it becomes slightly skewed relative to the sidewalls 58 and 60 and the other set of sidewalls 66 and 68. This tends to inhibit the movement of the block 20 from its mounting position, as shown in FIG. 2 and 12.

Figure 15:
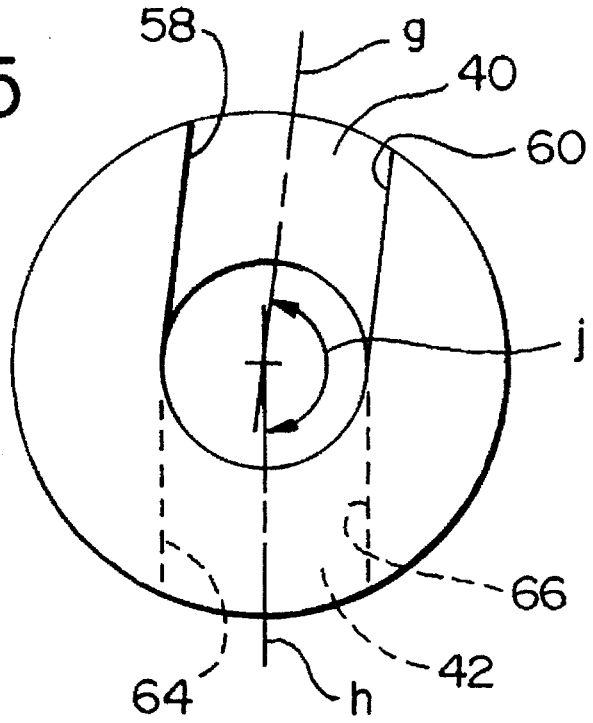
FIG. 15 is a somewhat schematic top plan view illustrating a third embodiment of the present invention, and more specifically illustrating the horizontal alignment relationship of the two lateral slats.
Figure 16:
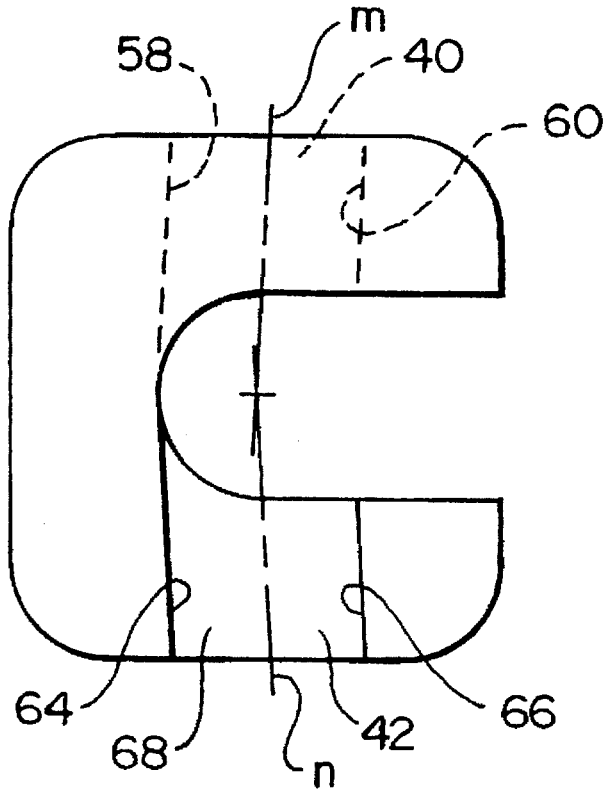
FIG. 16 is a schematic view of a fourth embodiment taken from a side location, showing the vertical alignment relationship to the two lateral slots.

The fourth embodiment is shown somewhat schematically in FIG. 15. In this instance, the upper sidewalls 60 and 62 are slightly out of vertical alignment relative to the lower sidewalls 66 and 68, the alignment axes shown at "m" and "n". Thus, this causes the stanchion 14 to come into firming gripping engagement in the slots 40 and 42. This also tends to inhibit the block at 20 from moving out of engagement with the stanchion 18.

Figure 17:
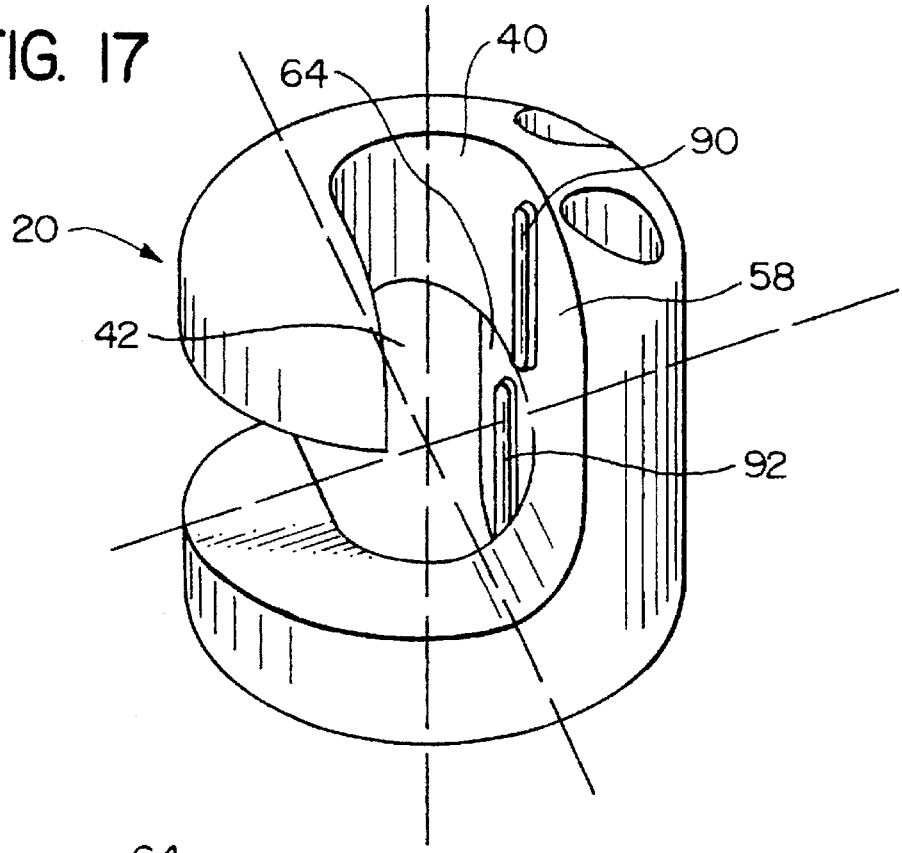
FIG. 17 is an isometric view of a block of the fifth embodiment of the present invention.
Figure 18:
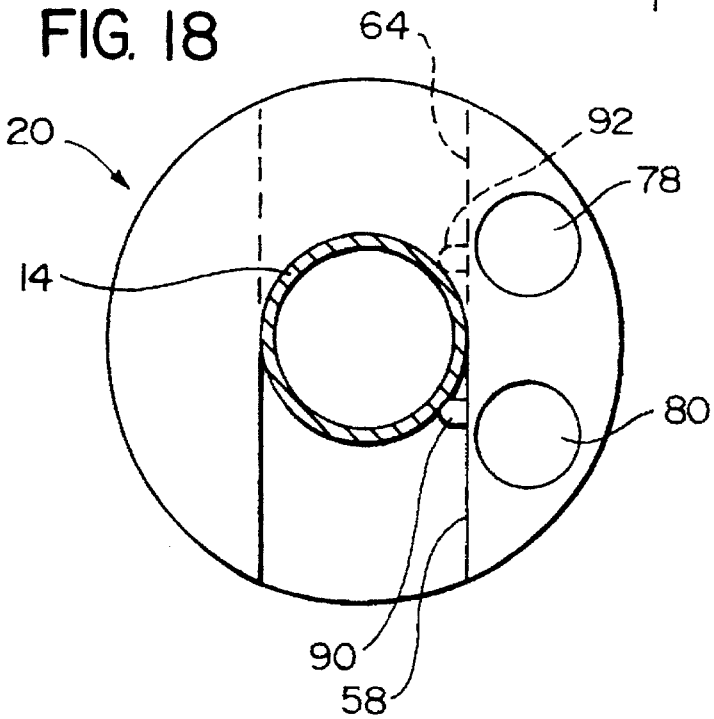
FIG. 18 is a top plan view of the block shown in FIG. 17.

A fifth embodiment of the present invention is shown in FIGS. 17 and 18. The block 20 is substantially the same as shown in FIGS. 2–12. To better secure the block to the stanchion 14, there is provided a vertically extending elongate protrusion 90 which extends outwardly from the upper rear wall 80 of the upper slot 40. In a similar manner, there is provided a lower vertically extending ridge or protrusion+ 92 which protrudes outwardly a short distance from the lower rear wall 64 defining the lower slot 42. As can be seen in FIG. 18, these protrusions 90 and 92 provide a resilient restraining means to maintain the block 20 mounted to the stanchion 14.

It is obvious that various modifications can be made t the present invention without departing from the basic teachings of the present invention.

I claim:

1. A mounting assembly for supporting an object, such as a fender, from a support structure, such as a boat, said assembly comprising:

a) an elongate substantially rigid support member having a maximum width dimension and supported from said support structure, said support member having a lengthwise center axis;

b) a mounting block adapted to be removably mounted to said support member, said block having a top, bottom, forward side, back side, and two lateral sides, said mounting block having a primary axis extending through said block from top to bottom, a forward to rear axis which extends through said block, with said primary axis having a major axis alignment component perpendicular to said forward to rear axis, and a lateral axis which extends a through said block and intersects both said primary axis and said front to rear axis, said lateral axis having a major alignment component generally perpendicular to both of said primary axis and said front to rear axis;

c) said block being formed with:

i. an access slot which lies in a plane having a substantial alignment component aligned with said lateral axis and said front to rear axis, said access slot opening from a front part of said block to the lateral axis, said access slot having a back wall positioned and configured to enable said support member to be positioned within said block to be generally aligned with said lateral axis;

ii. an upper positioning slot which extends from said primary axis laterally with said upper slot being configured to receive said support member, and having an inner surface portion at a base of the upper slot to engage the elongate member when it is positioned generally aligned with said primary axis;

iii. a lower positioning slot which extends from said primary axis laterally in a direction substantially opposite to said upper slot, with said lower slot being configured to receive said support member, and having an inner surface portion at a base of the lower slot to engage the elongate member when it is positioned generally aligned with said primary axis;

d. said access slot having slot defining surfaces which are spaced and configured to permit said block to be moved into engagement with said support member with said support member being received in said access slot and positioned at a base portion of said access slot so that the lengthwise axis of the support member is generally aligned with the lateral axis of the block, and also with the support member being generally aligned with said upper slot and said lower slot;

e. said upper slot opening to the base portion of the access slot, and said lower slot opening to the base portion of the access slot, each of said upper and lower slots having an open area sized to accommodate therein said support member, in a manner that with said support member being positioned at the base of the access slot, the block can be rotated in a plane generally occupied by the lateral axis and the primary axis to move to a position where the support member is positioned in the base portion of the upper and lower slots, and generally aligned with the primary axis;

f. said support member being sized relative to slot defining surfaces of the upper and lower slots so that the support member is engaged by said slot defining surfaces to hold the block in its supporting position on the support member;

g. a rope means having one end connected to said object which is to be supported, and a second end portion connecting to said block, whereby said block can be mounted to said support member by aligning the access slot with the support member and moving the block relative to the support member so that the support member moves into the access slot to be positioned in the base of the access slot, then rotating the block so that the support member passes into the upper and lower slots to position the block so that the primary axis of the block is substantially coincident with the lengthwise axis of the support member.

2. The assembly as recited in claim 1, wherein said block has an upper portion defining said upper slot, a lower portion defining said lower slot, and an intermediate portion positioned rearwardly of said access slot and interconnecting said upper portion and said lower portion, said intermediate portion forming with back parts of said upper portion and lower portion a back section of the block.

3. The assembly as recited in claim 2, wherein said back section of the block has through passageway means adapted to receive said rope means to connect the rope means to the block.

4. The assembly as recited in claim 3, wherein said passageway means comprises two passageways to receive said rope means in a manner that said rope means can be passed through said two passageways and be pulled into securing relationship with the two passageways.

5. The assembly as recited in claim 4, wherein said passageways are each aligned to have a substantially vertical alignment component.

6. The assembly as recited in claim 4, wherein said passageways are each aligned to have a substantial horizontal alignment component.

7. The assembly as recited in claim 1, wherein said upper slot has sidewalls defining said upper slot and said lower slot has sidewalls defining said lower slot, the sidewalls of said upper slot being moderately out of alignment with sidewalls of said lower slot, thus causing said sidewalls of said upper and lower slots to at least assist in providing gripping engagement to said support member.

8. The assembly as recited in claim 7, wherein lengthwise axes of said upper and lower slots form an angle less than 180°.

9. The assembly as recited in claim 7, wherein the sidewalls of the upper and lower slots are moderately out of parallel alignment with respect to each other, relative to said primary axis.

10. The assembly as recited in claim 1, wherein said block is of unitary structure made of a plastic material which is able to yield moderately to have a friction fit with said member.

11. A mounting block adapted to be mounted to an elongate substantially rigid support member for supporting an object, such as a fender, from a support structure, such as a boat, said mounting block comprising:

a. said mounting block having a top, bottom, forward side, back side, and two lateral sides, said block having a primary axis extending through said block from top to bottom, a forward to rear axis which extends through said block, with said primary axis having major axis alignment component perpendicular to said forward to rear axis, and a lateral axis which extends through said block and intersects both said primary axis and said front to rear axis, said lateral axis having a major alignment component generally perpendicular to both of said primary axis and said front to rear axis;

b. said block being formed with:

i. an access slot which lies in a plane having a substantial alignment component aligned with said lateral axis and said front to rear axis, said access slot opening from a front part of said block to the lateral axis, said access slot having a back wall positioned and configured to enable said support member to be positioned within said block to be generally aligned with said lateral axis;

ii. an upper positioning slot which extends from said primary axis laterally with said upper slot being configured to receive said support member, and having an inner surface portion at a base of the upper slot to engage the elongate member when it is positioned generally with said primary axis;

iii. a lower positioning slot which extends from said primary axis laterally in a direction substantially opposite to said upper slot, with said lower slot being configured to receive said support member, and having an inner surface portion at a base of the lower slot to engage the elongate member when it is positioned generally aligned with said primary axis;

d. said access slot having slot defining surfaces which are spaced and configured to permit said block to be moved into engagement with said support member with said support member being received in said access slot and positioned at a base portion of said access slot so that the lengthwise axis of the support member is generally aligned with the lateral axis of the block, and also with the support member being generally aligned with said upper slot and said lower slot;

e. said upper slot opening to the base portion of the access slot, and said lower slot opening to the base portion of the access slot, each of said upper and lower slots having an open area sized to accommodate therein said support member, in a manner that with said support member being positioned at the base of the access slot, the block can be rotated in a plane generally occupied by the lateral axis and the primary axis to move to a position where the support member is positioned in the base portion of the upper and lower slots and generally aligned with the primary axis;

f. said slot defining surfaces being sized relative to the support member so that the support member is engaged by said slot defining surfaces to hold the block in its supporting position on the support member;

whereby said block can be mounted to said support member by aligning the access slot with the support member and moving the block relative to the support member so that the support member moves into the access slot to be positioned in the base of the access slot, then rotating the block so that the support member passes into the upper and lower slots to position the block so that the primary axis of the block is substantially coincident with the lengthwise axis of the support member.

12. The block as recited in claim 11, wherein said block has an upper portion defining said upper slot, a lower portion defining said lower slot, and an intermediate portion positioned rearwardly of said access slot and interconnecting said upper portion and said lower portion, said intermediate portion forming with back parts of said upper portion and lower portion a back section of the block.

13. The block as recited in claim 12, wherein said back section of the block has through passageway means adapted to receive rope means to connect the rope means to the block.

14. The assembly as recited in claim 11, wherein said upper slot has sidewalls defining said upper slot and said lower slot has sidewalls defining said lower slot, the sidewalls of said upper slot being moderately out of alignment with sidewalls of said lower slot, thus causing said sidewalls of said upper and lower slots to at least assist in providing gripping engagement to said support member.

15. The assembly as recited in claim 11, wherein said block is of unitary structure made of a plastic material which is able to yield moderately to have a friction fit with said member.

16. A method for supporting an object, such as a fender, from an elongate substantially rigid support member of a support structure such as a boat, said method comprising;

a. providing a mounting block adapted to be removably mounted to said support member, said block having a top; bottom, forward side, back side, and two lateral sides, said mounting block having a primary axis extending through said block from top to bottom, a forward to rear axis which extends through said block, with said primary axis having a major axis alignment component perpendicular to said front to rear axis, and a lateral axis which extends through said block and intersects both said primary axis and said front to rear axis, said lateral axis having a major alignment component generally perpendicular to both of said primary axis and said front to rear axis;

b. providing said block with:

i. an access slot which lies in a plane having a substantial alignment component aligned with said lateral axis and said front to rear axis, said access slot opening from a front part of said block to the lateral axis, said access slot having a back wall positioned and configured to enable said support member to be positioned within said block to be generally aligned with said lateral axis;

ii. an upper positioning slot which extends from said primary axis laterally with said upper slot being configured to receive said support member, and having an inner surface portion at a base of the upper slot to engage the elongate member when it is positioned coincident with said primary axis;

iii. a lower positioning slot which extends from said axis laterally in a direction substantially opposite to said upper slot, with said lower slot being configured to receive said support member, and having an inner surface portion at a base of the lower slot to engage the elongate member when it is positioned coincident with said primary axis;

c. connecting said block to said object, with said support member and moving said block into engagement with said support member with said support member being received in said access slot and positioned at a base portion of said access slot so that the lengthwise axis of the support member is generally aligned with the lateral axis of the block, and also with the support member being generally aligned with said upper slot and said lower slot;

d. aligning said access slot with said support member and moving said block into engagement with said support member with said support member being received in said access slot and positioned at a base portion of said access slot so that the lengthwise axis of the support member is generally aligned with lateral axis of the block, and also with the support member being generally aligned with said upper slot and said lower slot;

e. rotating said block so that with said upper slot opening to the base portion of the access slot, and said lower slot opening to the base portion of the access slot and with each of said upper and lower slots having an open area sized to accommodate therein said support member, the block is rotated in a plane generally occupied by the lateral axis and the primary axis to move to a position where the support member is positioned in the base portion of the upper and lower slots and is generally aligned with the primary axis, slot defining surfaces of the upper and lower slots being sized and spaced so that the support member is engaged by said slot defining surfaces to hold the block in its supporting position on the support member.

17. The method as recited in claim 16, wherein said block has an upper portion defining said upper slot, a lower portion defining said lower slot, and an intermediate portion positioned rearwardly of said access slot and interconnecting said upper portion and said lower portion, said intermediate portion forming with back parts of said upper portion and lower portion a back section of the block.

18. The method as recited in claim 17, wherein said back section of the block has through passageway means, said method further comprising inserting rope means through said passageway means to secure the rope means to the block and connecting said rope means to said object.

19. The method as recited in claim 16, wherein said upper slot has sidewalls defining said upper slot and said lower slot has sidewalls defining said lower slot, the sidewalls of said upper slot being moderately out of alignment with sidewalls of said lower slot, thus causing said sidewalls of said upper and lower slots to at least assist in providing gripping engagement to said support member.

20. The method as recited in claim 16, wherein said object is a fender for marine use, and said block is mounted to an elongate member on a boat.

* * * * *